US012259173B2

(12) United States Patent
Cristiano et al.

(10) Patent No.: US 12,259,173 B2
(45) Date of Patent: Mar. 25, 2025

(54) REFRIGERATION APPLIANCE EQUIPPED WITH A REFRIGERATION SYSTEM HAVING A FAN FOR CIRCULATING AIR

(71) Applicant: ELECTROLUX APPLIANCES AKTIEBOLAG, Stockholm (SE)

(72) Inventors: Francesco Cristiano, Porcia (IT); Paolo Gasparotto, Porcia (IT); Paolo Ingargiola, Porcia (IT); Michele Sedrani, Porcia (IT)

(73) Assignee: Electrolux Appliances Aktiebolag, Stockholm (SE)

( * ) Notice: Subject to any disclaimer, the term of this patent is extended or adjusted under 35 U.S.C. 154(b) by 151 days.

(21) Appl. No.: 17/795,653

(22) PCT Filed: Oct. 7, 2020

(86) PCT No.: PCT/EP2020/078050
§ 371 (c)(1),
(2) Date: Jul. 27, 2022

(87) PCT Pub. No.: WO2021/190774
PCT Pub. Date: Sep. 30, 2021

(65) Prior Publication Data

US 2023/0060743 A1 Mar. 2, 2023

(30) Foreign Application Priority Data

Mar. 24, 2020 (EP) ..... 20165287
Mar. 24, 2020 (EP) ..... 20165291

(51) Int. Cl.
*F25D 17/06* (2006.01)
*F25D 17/04* (2006.01)

(52) U.S. Cl.
CPC ..... *F25D 17/065* (2013.01); *F25D 17/045* (2013.01); *F25D 2317/067* (2013.01);
(Continued)

(58) Field of Classification Search
CPC ..... F25D 17/065; F25D 17/045; F25D 2317/067; F25D 2317/0683; F25D 2317/0681; F25D 17/067
See application file for complete search history.

(56) References Cited

U.S. PATENT DOCUMENTS 3,365,118 A 1/1968 Winfield
4,893,478 A 1/1990 Kruck et al.
(Continued)

FOREIGN PATENT DOCUMENTS

CN 204438646 7/2015
CN 106958973 7/2017
(Continued)

OTHER PUBLICATIONS

European Communication in related application 20165287.2, dated Oct. 23, 2023, 5 pages.
(Continued)

*Primary Examiner* — Frantz F Jules
*Assistant Examiner* — Martha Tadesse
(74) *Attorney, Agent, or Firm* — Chrisman Gallo Tochtrop LLC

(57) ABSTRACT

The invention relates a refrigeration appliance (1) comprising a first compartment (10) and a second compartment (12) for receiving food items, said first compartment (10) and said second compartment (12) being separated one to the other. A refrigeration system (30) comprising an evaporator (38) is provided for cooling down air and a fan (72) forces the cooled air to the compartments (10, 12). The fan (72) comprises a rotor (82) with a rotation axis (X) which is inclined with respect to the vertical direction (V). A first ventilation assembly (50*a*) is apt to channel the cooled air forced by said fan (72) inside the first compartment (10) and a second ventilation assembly (50*b*) is apt to channel the
(Continued)

cooled air forced by the fan (72) inside the second compartment (12), wherein the first ventilation assembly (50*a*) and the fan (72) are associated to said first compartment (10). The refrigeration appliance (1) comprises an interconnection duct (110) configured to connect the first ventilation assembly (50*a*) to the second ventilation assembly (50*b*), said interconnection duct (110) being arranged downstream of the fan (72) to convey the cooled air forced by the fan (72) towards said second ventilation assembly (50*b*). The interconnection duct (110) extends along a main axis (Y) which is inclined with respect to the rotation axis (X) of the rotor (82) of an angle (W) comprised between 70° and 110°, preferably an angle (W) comprised between 85° and 100°, more preferably an angle (W) equal to 95°.

22 Claims, 12 Drawing Sheets

(52) U.S. Cl.
CPC ..... *F25D 2317/0681* (2013.01); *F25D 2317/0683* (2013.01)

(56) References Cited

U.S. PATENT DOCUMENTS

| | | | | |
|---|---|---|---|---|
| 5,255,535 | A | 10/1993 | Kennedy | |
| 2013/0098075 | A1 * | 4/2013 | Hegedus | F25D 16/00 62/426 |
| 2016/0153693 | A1 | 6/2016 | Oyu et al. | |
| 2019/0368800 | A1 | 12/2019 | Cheng et al. | |

FOREIGN PATENT DOCUMENTS

| | | | | |
|---|---|---|---|---|
| CN | 107388702 | | 12/2019 | |
| DE | 102016210708 | | 12/2017 | |
| JP | 2001194048 | A * | 7/2001 | |
| JP | 2018066346 | | 4/2018 | |
| JP | 2019100656 | | 6/2019 | |
| KR | 20010011784 | | 2/2001 | |
| WO | 2018113711 | | 6/2018 | |
| WO | WO-2018113711 | A1 * | 6/2018 | F25D 17/04 |
| WO | 2020246829 | | 12/2020 | |

OTHER PUBLICATIONS

International Search Report for PCT/EP2020/078050 dated Nov. 19, 2020, 3 pages.
Brazilian OA for application BR112022018734-3, dated Apr. 15, 2024, 4 pages.

* cited by examiner

REFRIGERATION APPLIANCE EQUIPPED WITH A REFRIGERATION SYSTEM HAVING A FAN FOR CIRCULATING AIR

FIELD OF THE INVENTION

The present invention relates to a refrigeration appliance equipped with a refrigeration system, more specifically to a refrigeration appliance equipped with a refrigeration system having a fan for circulating air within two compartments of the refrigeration appliance.

BACKGROUND ART

Refrigeration appliances of known types generally include an inner liner disposed within an outer cabinet. The inner liner typically defines one or more compartments, for example a fresh food compartment and a freezer compartment. Each compartment has an open front closed by a door pivotally mounted to the outer cabinet. Compartments are preferably provided with shelves and/or storage drawers to receive items therein.

A refrigeration system is provided to cool the compartments. The refrigeration system typically includes an evaporator, which is preferably mounted inside one of the compartments, and a fan for creating a cooling air stream for the compartment/s. The cooling air stream is preferably circulated in a closed loop, or recirculated, inside the compartment/s.

The air passes over, or through, the evaporator which cools the air and then the air is conveyed inside the compartment/s. The fan is typically arranged downstream of the evaporator and conveys the cooled air, coming from the evaporator, inside the compartment/s. Hence the fan typically sucks cooled air coming from the evaporator and expels it towards the compartment/s.

In order to convey the expelled cooled air by the fan into the compartment/s one or more air ducts are realized from the fan to respective air openings opportunely distributed at rear and/or lateral sides of the compartment/s for a uniform cooling. In systems of know types, the refrigeration appliance has two compartments, for example a fresh food compartment placed above a freezer compartment, and the evaporator and the fan are preferably mounted inside a first one of the two compartments. Appropriate ducts are then opportunely configured to channel the air forced by the fan towards the first and the second compartments.

Furthermore, the evaporator is opportunely arranged in a chamber, or channel, where the cooling air flows, and the lower part of the channel is preferably provided with a collecting tray to collect water formed by condensation on the evaporator.

It is an aim for manufacturers and scope of the invention to find solutions that optimize the functioning of the refrigeration system, in particular solutions that optimize the cooling air flowing from the fan to the compartments, solutions leading to the reduction of encumbrance and solutions leading to reduction of noise caused by the flowing air and/or caused by the fan rotation.

DISCLOSURE OF INVENTION

The applicant has found that by providing a refrigeration appliance with a refrigeration system comprising an evaporator for cooling down air and a fan configured to force the cooled air to compartments of the appliance and by providing a duct downstream of the fan with a proper inclination, it is possible to reach the above-mentioned scopes.

According to one aspect of the present disclosure there is provided a refrigeration appliance comprising:

- an outer cabinet comprising a base suitable to lay on the ground, a roof and lateral side walls connecting said base and said roof in a vertical direction;
- a first compartment, internal to said outer cabinet, with an opening for receiving food items and a second compartment, internal to said outer cabinet, with an opening for receiving food items, said first compartment and said second compartment being separated one to the other;
- a refrigeration system comprising an evaporator for cooling down air and a fan configured to force the cooled air to said compartments, said fan comprising a rotor with a rotation axis which is inclined with respect to the vertical direction;
- a first ventilation assembly apt to channel said cooled air forced by said fan inside said first compartment and a second ventilation assembly apt to channel said cooled air forced by said fan inside said second compartment, said first ventilation assembly and said fan being associated to said first compartment;

wherein said refrigeration appliance comprises an interconnection duct configured to connect said first ventilation assembly to said second ventilation assembly, said interconnection duct being arranged downstream of said fan to convey the cooled air forced by said fan towards said second ventilation assembly, wherein said interconnection duct extends along a main axis which is inclined with respect to said rotation axis of said rotor of an angle comprised between 70° and 110°, preferably an angle comprised between 85° and 100°, more preferably an angle equal to 95°.

Advantageously, the air coming from the rotor is smoothly conveyed towards the second ventilation assembly. Air flow is therefore advantageously distributed with low turbulence along the interconnection duct thus optimizing the cooling air flowing from the rotor to the second compartment. Still advantageously, noise during operation is keep low due to low turbulence of the air flows.

Preferably, the interconnection duct extends between a first end and a second end, said main axis being defined as the axis passing through the barycentre of a cross sectional area at said first end and the barycentre of a cross sectional area at said second end.

According to a preferred embodiment of the invention, the interconnection duct is an interconnection rectilinear duct.

With rectilinear duct it is meant a volume enclosed by at least one side wall allowing an air flow to be channelled along a rectilinear, or substantially rectilinear, flow direction. Preferably said at least one side wall is a rectilinear, or substantially rectilinear, side surface. Preferably said rectilinear, or substantially rectilinear, side surface extends parallelly, or substantially parallelly, to said flow direction.

In other words, with rectilinear duct it is meant an extension of lateral walls of the duct from a cross section provided on a first end to a second end along a rectilinear direction.

Preferably, the interconnection duct is defined by at least one side wall. More preferably said at least one side wall is a rectilinear side wall.

In a preferred embodiment, the vertical direction and the rotation axis of the rotor form an angle therebetween greater than 90° and lower than 180°, preferably an angle greater than 92° and lower than and 115°, more preferably an angle equal to 105°.

Advantageously, by providing such an inclination for the rotor, and hence for the fan, an adequate space/room is created at the suction side of the fan. Said space allows to optimize the air stream from the evaporator to the fan and to improve fluid dynamics to achieve higher performance so that turbulence and/or noise caused by air flow may be reduced.

Still advantageously, the rotor having such an inclination reduces encumbrance of the rotor and the fan in the area where they are mounted.

According to a preferred embodiment of the invention, the first ventilation assembly and the fan are arranged inside the first compartment.

In a preferred embodiment of the invention, the second ventilation assembly is associated to the second compartment, more preferably is arranged inside the second compartment.

Preferably, the first compartment and the second compartment are separated by a partition element and the interconnection duct is at least in part defined by a duct portion defined in the partition element.

According to a preferred embodiment of the invention, the second ventilation assembly comprises one or more outlet openings apt to channel the cooled air forced by the fan and flowing through the interconnection duct inside the second compartment.

In a preferred embodiment of the invention, the second ventilation assembly further comprises an inlet duct portion arranged upstream of the outlet openings, wherein the interconnection duct is at least in part defined by the inlet duct portion of the second ventilation assembly.

Preferably, the outlet openings are arranged vertically one above the other, more preferably the size of an outlet opening of said outlet openings is higher than the size of an outlet opening arranged below.

Advantageously, the cooling air is uniformly distributed inside the second compartment. The temperature inside the second compartment is more uniformly maintained going from the upper to the lower part of the second compartment. Advantageously, different temperatures, or air stratification, inside the second compartment are prevented/avoided.

According to a preferred embodiment of the invention, the second ventilation assembly further comprises one or more inlet openings apt to withdraw air from the second compartment towards the first compartment and/or back to the evaporator.

In a preferred embodiment of the invention, the inlet openings are arranged vertically one above the other.

Preferably, the size of each inlet opening is opportunely dimensioned so that the flow rate of the air leaving the second compartment through the inlet openings is the same, or substantially the same, for each inlet opening.

Advantageously, the air leaves the second compartment through the inlet openings in an equally distributed manner going from the upper to the lower part of the second compartment.

Again, advantageously, the cooling air is uniformly distributed inside the second compartment. The temperature inside the second compartment is more uniformly maintained going from the upper to the lower part of the second compartment. Advantageously, different temperatures, or air stratification, inside the second compartment are prevented/avoided.

According to a preferred embodiment of the invention, the second ventilation assembly further comprises a septum element arranged in correspondence of one or more of the inlet openings to at least partially obstruct the air passing therethrough. Preferably, the septum element is arranged in correspondence of one or more lowermost inlet openings of said inlet openings.

Advantageously, in correspondence of one or more lowermost inlet openings the effective flow rate decreases with respect to uppermost inlet openings thus enhancing an equal distribution of air leaving the second compartment going from the upper to the lower part of the same second compartment.

According to a preferred embodiment of the invention, said outlet openings are arranged at one lateral side of said second ventilation assembly and/or said inlet openings are arranged at a second lateral side of said second ventilation assembly.

In a preferred embodiment of the invention, said one lateral side and said second lateral side are opposite sides of said second ventilation assembly.

Preferably, the evaporator comprises a first lateral surface extending longitudinally along a first axis and a second lateral surface facing the first lateral surface, said evaporator being positioned so that said first axis of the first lateral surface is inclined with respect to the vertical direction.

Advantageously, by providing such an inclination for the first lateral surface of the evaporator, and hence such an inclination for the evaporator, an adequate space/room is created at the upper zone of the evaporator. Said space is advantageously available and utilized for mounting or arranging one or more operating components, for example the fan.

Said space further allows to optimize the air stream from the evaporator to the fan, in particular the air stream leaving the upper surface of the evaporator reaching the fan, and/or allows to optimize the realization of ducts for the air expelled by the fan towards the compartments.

Still advantageously, more space may be created between the evaporator and the fan, in particular between the upper surface of the evaporator and the fan, so that turbulence and/or noise caused by air flow may be reduced.

According to another advantageous aspect of the invention, by providing such an inclination for the first lateral surface of the evaporator, the condensed water generated during operation drops, without freezing, to the closed first lateral surface and reaches a collecting tray by slipping over the first lateral surface.

In a preferred embodiment of the invention, an air channel is provided for receiving the evaporator. The fan is preferably associated to the evaporator for creating an air stream which is channelled towards the evaporator inside said air channel and then inside said compartments, the fan and the air channel being configured so that the air stream vertically flows inside the air channel.

For air stream vertically flowing inside the air channel it is meant that the air stream flows from the bottom to the upper side of the channel or vice versa.

In a preferred embodiment, the first lateral surface of the evaporator is inclined with respect to the vertical direction so that the lower part of the first lateral surface is closer to the internal volume of the first or second compartment than the upper part of the first lateral surface of the evaporator.

In a preferred embodiment, the first lateral surface and the second lateral surface of the evaporator are parallel one to the other.

Preferably the first lateral surface, the second lateral surface, the upper surface and the lower surface of the evaporator are arranged to define a parallelepiped.

According to a preferred embodiment of the invention, the evaporator comprises a bent tube having multiple sections one above the other and a plurality of stacked fins provided with holes receiving the bent tube.

Preferably, the first axis of the first lateral surface of the evaporator is inclined with respect to the vertical direction of an angle comprised between 1° and 10°, preferably of an angle comprised between 2° and 5°, more preferably of an angle equal to 3°.

It has been surprisingly discovered that by inclining the evaporator with an angle within these ranges, the condensed water generated during operation drops, without freezing, to the closed first lateral surface to reach then the collecting tray but, at the same time, due to its inclination the evaporator does not strongly affect the encumbrance of the refrigeration system.

According to a preferred embodiment of the invention, the fan is arranged inside the air channel.

According to a preferred embodiment of the invention, the fan is arranged downstream said evaporator.

In a preferred embodiment, the fan is arranged above the evaporator.

In a preferred alternative embodiment, the fan is arranged outside the air channel.

In a preferred embodiment, the first axis of the first lateral surface of the evaporator and the rotation axis of the rotor form an angle therebetween comprised between 70° and 110°, preferably an angle comprised between 90° and 105°, more preferably an angle equal to 102°.

Advantageously, by providing said mutual inclination between the first lateral surface of the evaporator and the rotor, it is possible to further optimize the air stream from the evaporator to the fan, in particular the air stream leaving the upper surface of the evaporator and reaching the fan.

Advantageously, it is possible to further reduce the noise of the air stream, in particular the noise of the air stream leaving the upper surface of the evaporator and reaching the fan.

Still advantageously, by providing said mutual inclination between the first lateral surface of the evaporator and the rotor, it is possible to reduce the encumbrance of the system and to optimize the size of the same.

Preferably, the air channel is defined inside the first compartment, preferably at a first wall of the first compartment, more preferably at a rear wall of the first compartment.

According to an alternative preferred embodiment of the invention, the air channel is positioned outside the first compartment.

In a preferred embodiment, said refrigeration system further comprises a water collecting zone arranged below said evaporator to collect water formed by condensation on said evaporator.

Preferably, said refrigeration system further comprises a collecting tray associated to the water collecting zone.

According to a preferred embodiment of the invention, the air channel comprises a first lateral surface.

In a preferred embodiment, the first lateral surface of the evaporator is supported by the first lateral surface of the air channel.

Advantageously, the condensed water generated during operation drops to the first lateral surface of the air channel and reaches the collecting tray by slipping over the said first lateral surface of the air channel Preferably, the first lateral surface of the air channel is defined by the first wall of the first compartment.

BRIEF DESCRIPTION OF THE DRAWINGS

Further characteristics and advantages of the present invention will be highlighted in greater detail in the following detailed description of a preferred embodiment of the invention, provided with reference to the enclosed drawings. In said drawings.

DETAILED DESCRIPTION OF A PREFERRED EMBODIMENT OF THE INVENTION

Figure 2:
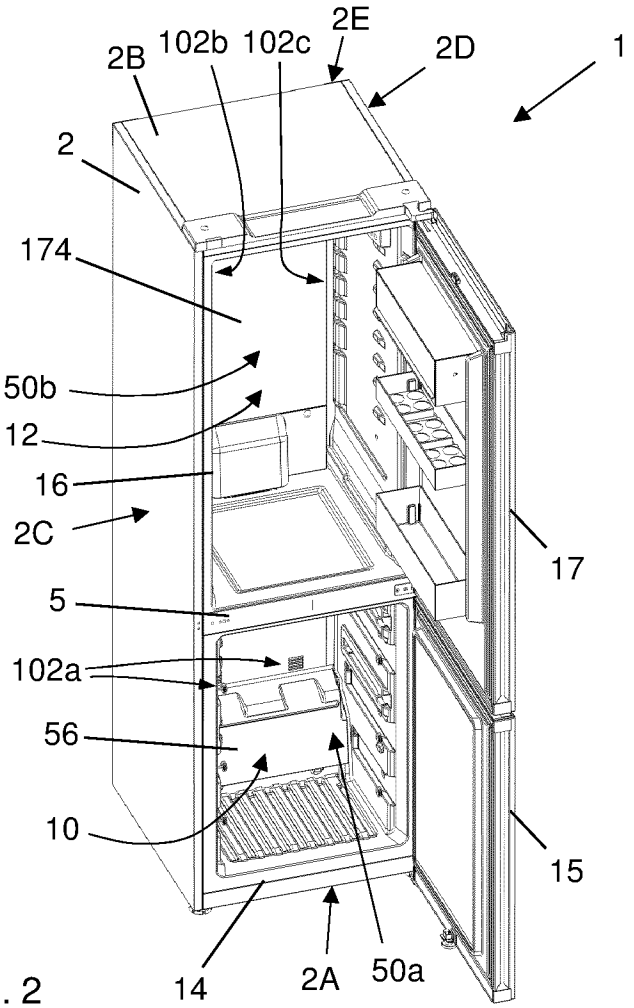
FIG. 2 shows the appliance of FIG. 1 with some elements removed therefrom.
Figure 1:
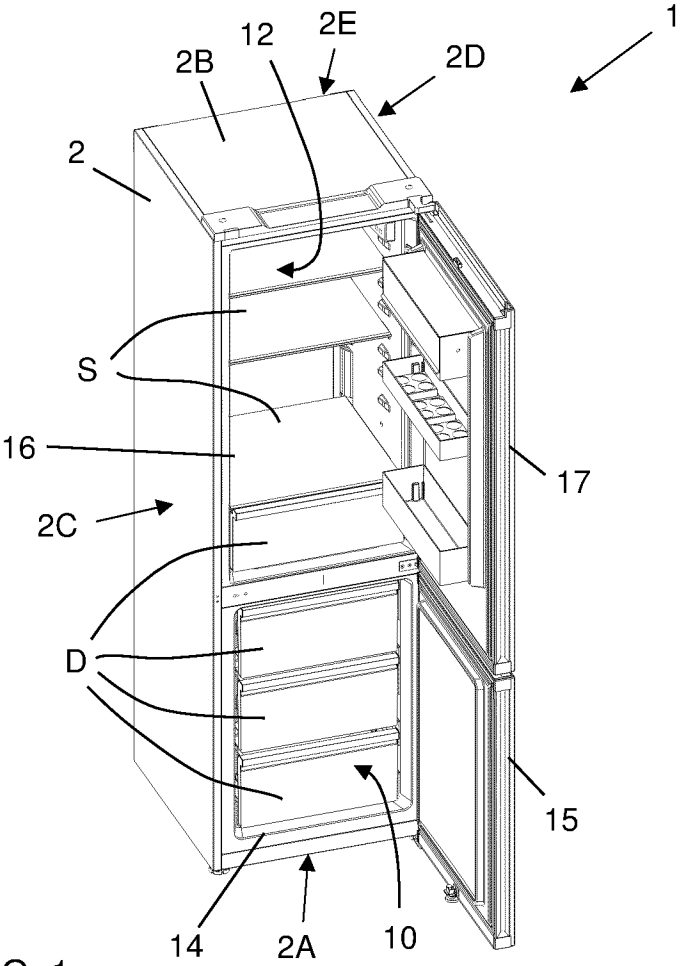
FIG. 1 shows an isometric view of a refrigeration appliance according to a preferred embodiment of the present invention.

Referring to FIGS. 1 and 2 a refrigeration appliance in the form of a domestic refrigerator is shown, indicated generally as 1. Although the detailed description that follows concerns a domestic stand-alone refrigerator 1, the refrigeration appliance can be embodied by refrigeration appliances other than a domestic refrigerator.

Furthermore, the embodiment described in detail below refers to a bottom mount refrigerator, i.e. of the type including a freezer compartment disposed vertically below a fresh food compartment. However, the refrigerator according to the invention can have any desired configuration comprising at least two compartments, for example a top mount refrigerator wherein the freezer compartment is disposed vertically above the fresh food compartment.

Furthermore, while the present application is described with reference to a stand-alone refrigerator it has to be noted that also a built-in solution may be contemplated.

The refrigeration appliance 1 illustrated in the figures, hereinafter indicated also as refrigerator 1, comprises an outer cabinet 2 and an inner liner 22, internally received in the outer cabinet 2. The outer cabinet 2 and the inner liner 22 are separated by a spacing filled with thermal insulation 13, preferably a foam insulation.

The outer cabinet 2 preferably extends in a vertical direction V and preferably comprises a base 2A suitable to lay on the ground, a roof 2B and lateral side walls 2C, 2D, 2E connecting the base 2A and the roof 2B, preferably two lateral side walls 2C, 2D and a rear side wall 2E.

In its installed position, lateral side walls 2C, 2D and the rear side wall 2E are preferably aligned to the vertical direction V.

The refrigerator 1 according to the embodiment shown in the figures preferably represents a bottom mount type refrigerator. At this purpose, a divider portion 5, or partition element 5, is provided which divides the inner liner 22 into a lower space that is used as a freezer compartment 10, and an upper space that is used as a fresh food compartment 12.

In a preferred embodiment, the partition element 5 is constituted by a separate element which is fixedly mounted to the inner liner 22 during manufacturing of the refrigerator 1. In further preferred embodiments, the partition element may be constituted by a shaped portion of the inner liner so that the partition element is integrally made with, and is integral part of, the inner liner itself.

The freezer compartment 10 substantially preferably has the form of a cuboid defining a rectangularly shaped front opening 14. A door 15 is preferably pivotally mounted to the outer cabinet 2 and is movable between an open position and a closed position to cover the front opening 14.

The freezer compartment 10 preferably shows a rear wall 24 (FIG. 3) which is defined by a portion of the inner liner 22, more preferably a rear shaped wall 24.

Analogously, the fresh food compartment 12 substantially and preferably has the form of a cuboid defining a rectangularly shaped front opening 16. A door 17 is preferably pivotally mounted to the outer cabinet 2 and is movable between an open position and a closed position to cover the front opening 16.

The fresh food compartment 12 preferably shows a rear wall 26 which is defined by a portion of the inner liner 22, more preferably a vertical rear shaped wall 26.

In an alternative embodiment, a single door can be provided to open and close both the front openings 14, 16 of the freezer and the fresh food compartments 10, 12.

The compartments 10, 12 preferably comprise shelves S and/or drawers D for receiving food items.

A refrigeration system 30 is preferably provided to cool the compartments 10, 12.

According to the present invention, the refrigeration system 30 is apt to cool down an air stream which is circulated inside both compartments 10, 12.

In the preferred embodiment of the invention, the refrigeration system 30 preferably comprises a closed recirculating system filled with a suitable refrigerant, for example R12 or R134a or R660a. The refrigeration system 30 preferably comprises an electric motor-driven compressor 32, a condenser heat exchanger 34, a pressure device such as a capillary tube or a thermostatic valve (not shown) and an evaporator 38.

The compressor 32 is preferably mounted external to the freezer compartment 10 and more preferably arranged in a working chamber 21 at the bottom of the refrigerator 1.

The condenser heat exchanger 34 can be a condenser tubing that preferably has a serpentine configuration and is preferably externally secured to the rear side wall 2E of the outer cabinet 2 so as to form what is commonly known as a "hot wall".

The evaporator 38 is the component of the refrigeration system 30 apt to cool down the air stream for the compartments 10, 12.

A fan 72 is preferably associated to the evaporator 38 for creating the air stream. The function of the fan 72 is to generate the cooling air stream that is forced and recirculated inside the compartments, preferably the freezer compartment 10 and the fresh food compartment 12. The fan 72 is preferably configured to draw air from the evaporator 38 and to expel it into the freezer compartment 10 and into the fresh food compartment 12.

An air channel 40, or air chamber 40, preferably receives the evaporator 38 and has the function to confine the air stream, preferably to confine the air stream in correspondence of the evaporator 38. Preferably, the fan 72 creates the air stream which is channelled towards the evaporator 38 inside the air channel 40 and then inside the compartments 10, 12, as better described later. The lower part of the air channel 40 is preferably configured to define a water collecting zone 44 to collect water formed by condensation on the evaporator 38. A collecting tray 55 is preferably fluidly connected to the water collecting zone 44.

In the preferred embodiment as illustrated in the figures, the fan 72 is preferably arranged inside the air channel 40. In different preferred embodiments, nevertheless, the fan may be arranged in any points of the refrigerator allowing the creation of an air stream which is channelled towards the evaporator inside the air channel.

Preferably, the fan 72 is arranged downstream the evaporator 38.

It is underlined that in the present application the term "downstream" is referred to the flowing direction of the air during the standard functioning of the refrigerator 1, i.e. saying that the fan 72 is arranged downstream the evaporator 38 means that in the standard functioning of the refrigerator 1 the air firstly circulates over or through the evaporator 38 and then passes through the fan 72.

Preferably, as illustrated in the figures, the fan 72 is arranged above the evaporator 38, more preferably just above the evaporator 38.

The fan 72 preferably comprises a rotor 82, or impeller, with a rotation axis X.

The fan 72 preferably comprises a centrifugal fan, preferably a radial fan. The air flows from a suction side 72A of the fan 72 facing the evaporator 38, as depicted in FIG. 14, and the air is then displaced radially, changing its direction (typically by 90°). The rotor 82 preferably consists of a rotating arrangement of vanes or blades, rotating around said axis X, which act on the air.

A suction chamber 68 is preferably created at the suction side 72A between the fan 72 and the evaporator 38, as shown in FIG. 14.

The air expelled by the fan 72 is then conveyed into the compartments 10, 12, as better described later.

According to an aspect of the invention, the rotation axis X of the rotor 82 is inclined with respect to the vertical direction V.

Figure 14A:
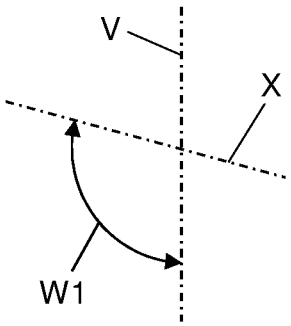
FIGS. 14A, 14B and 14C show details of axes shown in FIG. 14.

The vertical direction V and the rotation axis X of the rotor 82 form an angle W1 therebetween preferably greater than 90° and lower than 180°, more preferably an angle greater than 92° and lower than and 115°, even more preferably an angle equal to 105°, as illustrated in FIG. 14A.

Advantageously, by providing such an inclination for the rotor 82, and hence for the fan 72, an adequate space/room is created for the suction chamber 68. Said space allows to optimize the air stream from the evaporator 38 to the fan 72 and to improve fluid dynamics to achieve higher performance so that turbulence and/or noise caused by air flow may be reduced.

Still advantageously, the rotor 82 having such an inclination reduces encumbrance of the rotor 82 and the fan 72 in the area where they are mounted.

According to an aspect of the present invention, the refrigerator 1 preferably comprises a first ventilation assembly 50*a* apt to channel the cooled air forced by the fan 72 inside the first compartment 10, preferably the freezer compartment 10, and a second ventilation assembly 50*b* apt to channel the cooled air forced by the fan 72 inside the second compartment 12, preferably the fresh food compartment 12.

The first ventilation assembly 50*a* and the fan 72 are preferably associated to the freezer compartment 10, more preferably arranged inside the freezer compartment 10, as better illustrated in FIG. 14.

Figure 4:
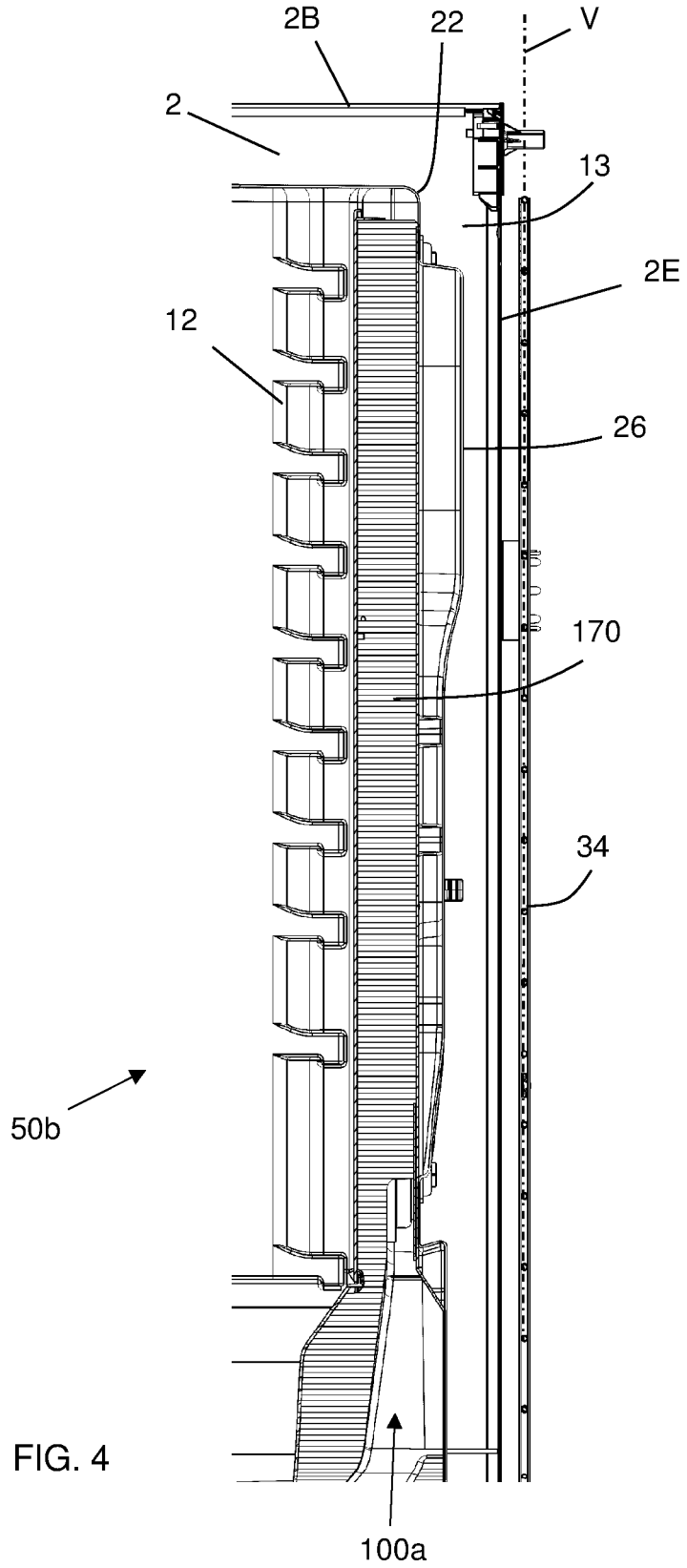
FIG. 4 shows an enlarged view of a particular of FIG. 3.
Figure 6:
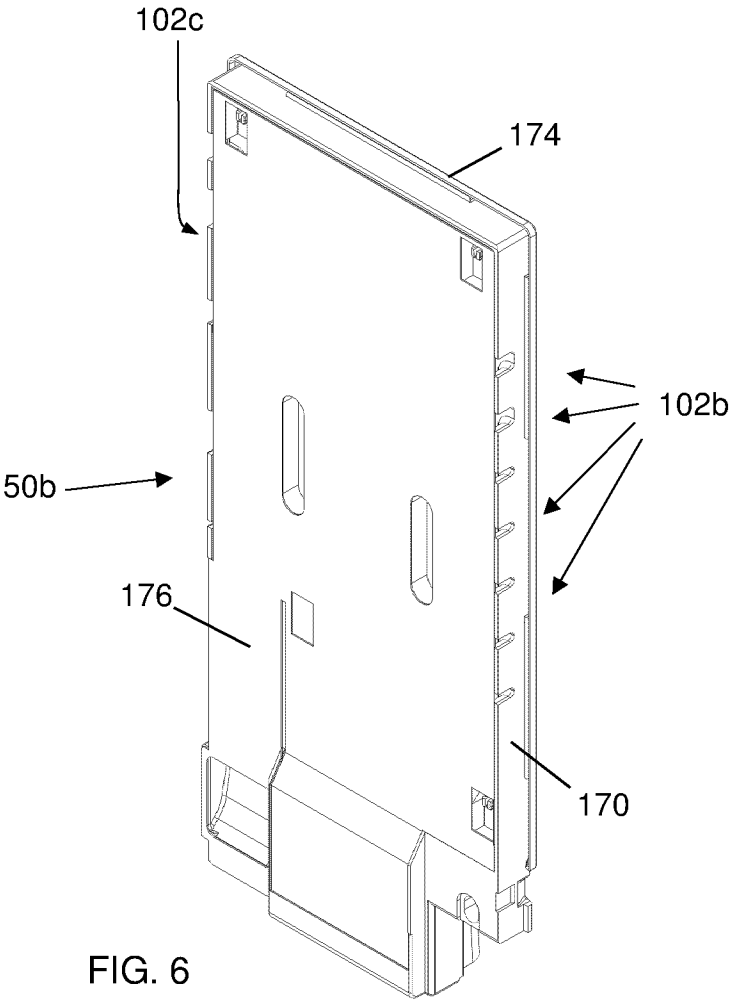
FIG. 6 shows the isometric view of FIG. 5 from another point of view.
Figure 5:
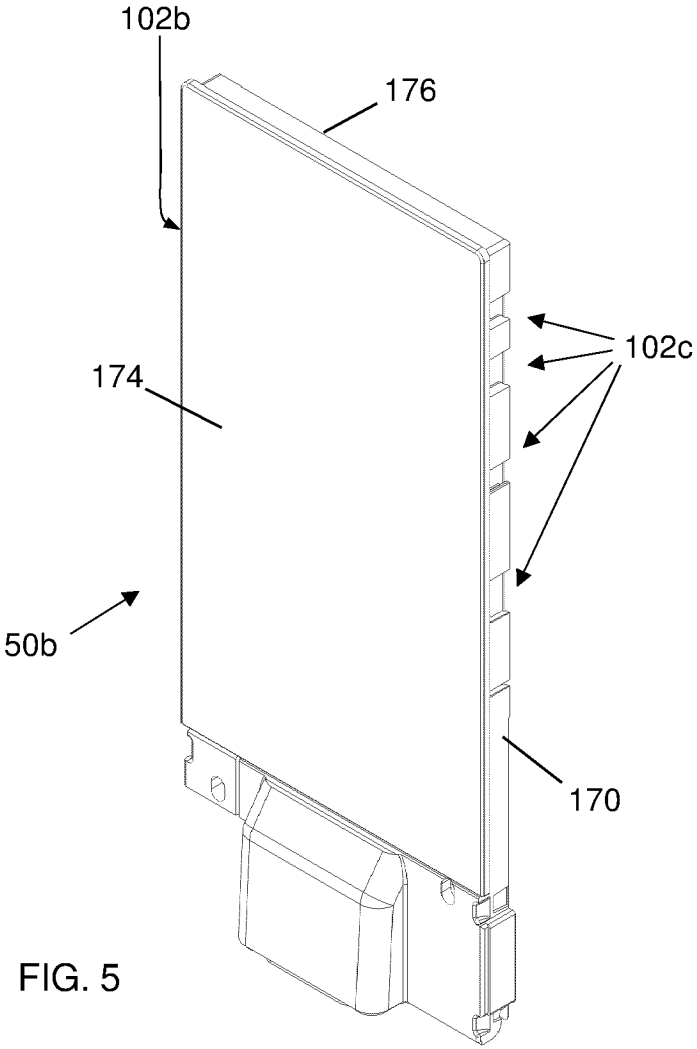
FIG. 5 shows an isometric view of a ventilation assembly according to a preferred embodiment of the present invention.
Figure 7:
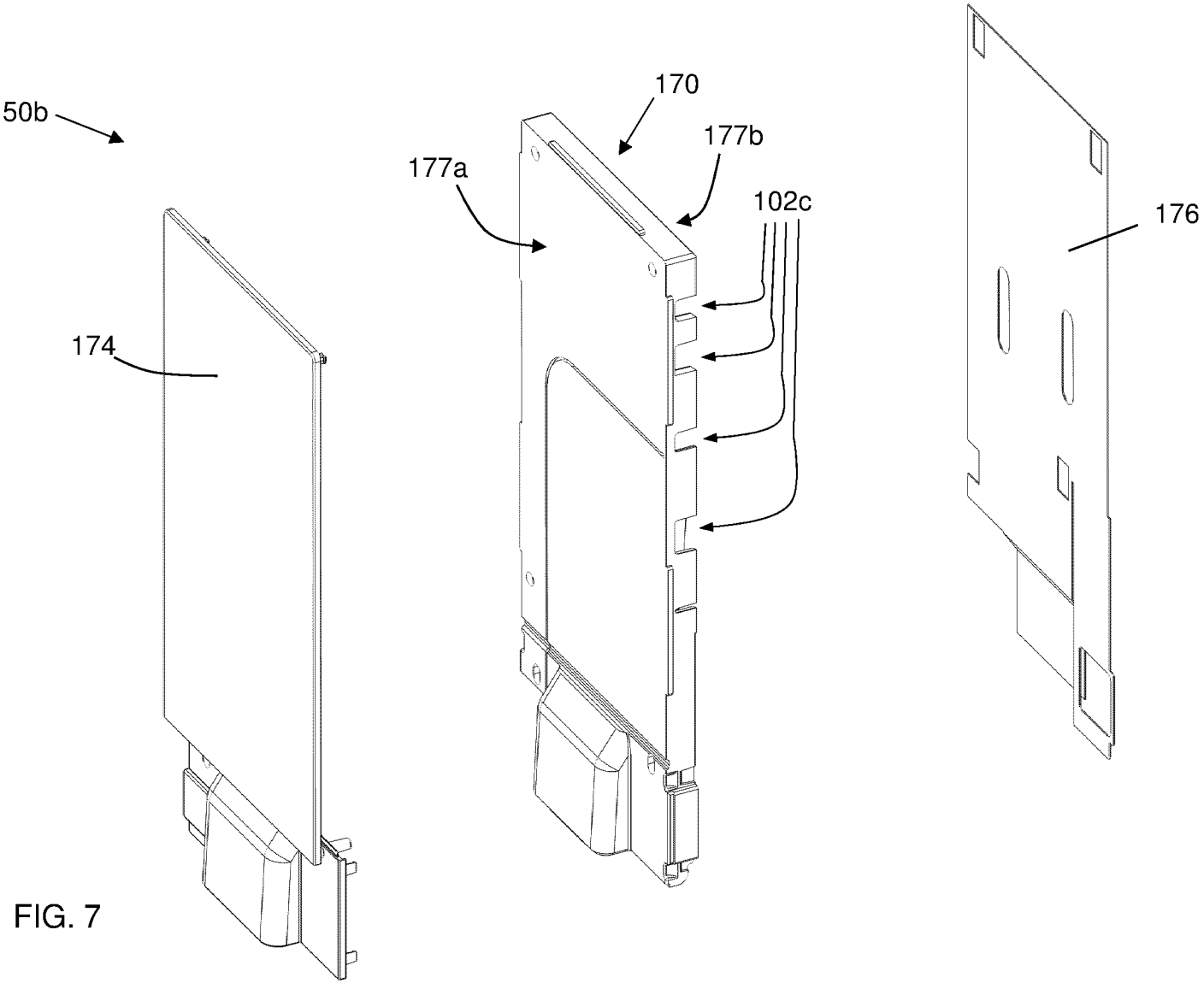
FIG. 7 shows an exploded view of FIG. 5.

The second ventilation assembly 50*b* is preferably associated to the fresh food compartment 12, more preferably is arranged inside the fresh food compartment 12, as better illustrated in FIG. 4.

In different embodiments, not illustrated, the first ventilation assembly and/or the second ventilation assembly and/or the fan may be arranged outside the first or the second compartment, respectively, being clear that the two ventilation assemblies are apt to channel the cooled air from the fan to the inside of the compartments.

Figure 3:
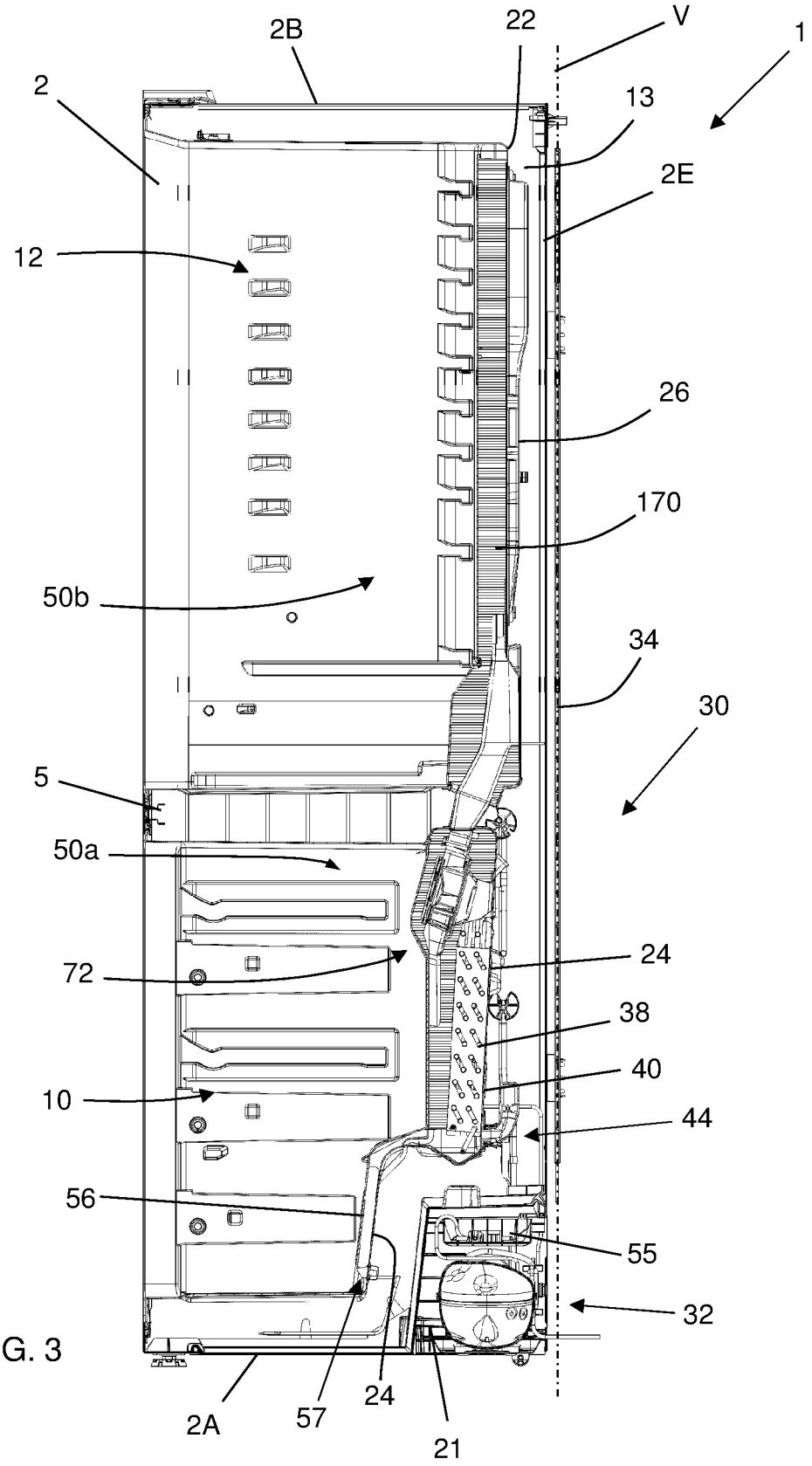
FIG. 3 shows a vertical plan sectional view of the appliance of FIG. 2.

The first ventilation assembly 50*a* is preferably configured to draw air from the evaporator 38 and to expel it into the freezer compartment 10 through lower air outlet openings 102*a* (some of them visible in FIG. 2) opportunely distributed inside the freezer compartment 10. Air from the freezer compartment 10 flows back to the evaporator 38, preferably back to the air chamber 40 receiving the evaporator 38, through an air inlet 57 preferably defined between an air conveyor 56 applied at the lower part of the freezer compartment 10 and the rear wall 24, as indicated in FIG. 3.

The second ventilation assembly 50*b* is preferably configured to draw air from the evaporator 38 and to expel it into the fresh food compartment 12 through a plurality of upper outlet openings 102*b*. The upper outlet openings 102*b* are preferably arranged along a first row of vertical upper outlet openings 102*b* (on the left side of the fresh food compartment 12 in the frontal view of FIG. 2).

Air from the fresh food compartment 12 is preferably conveyed to the freezer compartment 10 and from there the air flows back to the evaporator 38 through the air inlet 57 as explained above.

A plurality of upper inlet openings 102*c* are preferably arranged along a second row of vertical upper inlet openings 102*c* (on the right side of the fresh food compartment 12 in the frontal view of FIG. 2) for the conveyance of the air from the fresh food compartment 12 to the freezer compartment 10 and/or back to the evaporator 38.

Therefore, preferably, the upper outlet openings 102*b* and the upper inlet openings 102*c* are arranged, respectively, at one lateral side (left side) of the second ventilation assembly 50*b* and at a second lateral side (right side) of the second ventilation assembly 50*b*. More preferably, therefore, the upper outlet openings 102*b* and the upper inlet openings 102*c* are arranged at opposite sides of the second ventilation assembly 50*b*.

The air flow generated by the fan 72 is preferably channelled towards the freezer compartment 10 by providing air ducts, not shown, in the first ventilation assembly 50*a* and extending downwardly from the fan 72 with the function of channelling the cooled air expelled by the fan 72 towards the air openings 102*a*.

Analogously, the air flow generated by the fan 72 is preferably channelled towards the fresh food compartment 12 by providing a first air duct 100*a* in the second ventilation assembly 50*b* with the function of channelling the cooled air expelled by the fan 72 towards the upper outlet openings 102*b*.

The first ventilation assembly 50*a* preferably comprises a first layer 70 of expanded polystyrene, the fan 72, a second layer 74 of expanded polystyrene and a cover plate 76, as illustrated in FIG. 14.

The first layer 70, the fan 72, the second layer 74 and the cover plate 76 are preferably arranged side by side, i.e. arranged one laterally of the other and preferably in a lateral order perpendicular to the vertical direction V. In other words, each component 70, 72, 74, 76 is at least partially stacked/in contact to the laterally adjacent component.

Preferably, expanded polystyrene used for the layers 70, 74, i.e. EPS, is a lightweight, rigid plastic foam insulation material made of solid polystyrene particles.

The use of EPS enhances thermal isolation of the first ventilation assembly 50*a*, being EPS a high-quality thermal insulator material.

In addition, the use of EPS enhances acoustic isolation of the first ventilation assembly 50*a*, in particular of noise caused by rotation of the fan 72 and of the air expelled from it.

Furthermore, using of EPS simplifies the first ventilation assembly 50*a* construction as EPS is an easily handled material. Still advantageously, EPS is a cheap material.

In a further preferred embodiment, not shown, the second layer of expanded polystyrene may be omitted.

The fan 72, as described above, preferably comprises a rotor 82 with a rotation axis X.

Preferably, as illustrated in FIG. 14, a fan mouth 122 is arranged at the suction side 72A of the fan 72 that enhances conveyance of the air from the evaporator 38 to the rotor 82. The fan mouth 122 preferably faces the evaporator 38 and is preferably placed between the first layer 70 and the fan 72.

In different preferred embodiments, the fan mouth may be omitted.

The suction chamber 68 is then preferably created between the fan mouth 122, and the evaporator 38, as shown in FIG. 14. The fan 72 draws air from the evaporator 38 through the suction chamber 68 and expels it towards the freezer compartment 10 and the fresh food compartment 12, as better described later.

Figure 8:
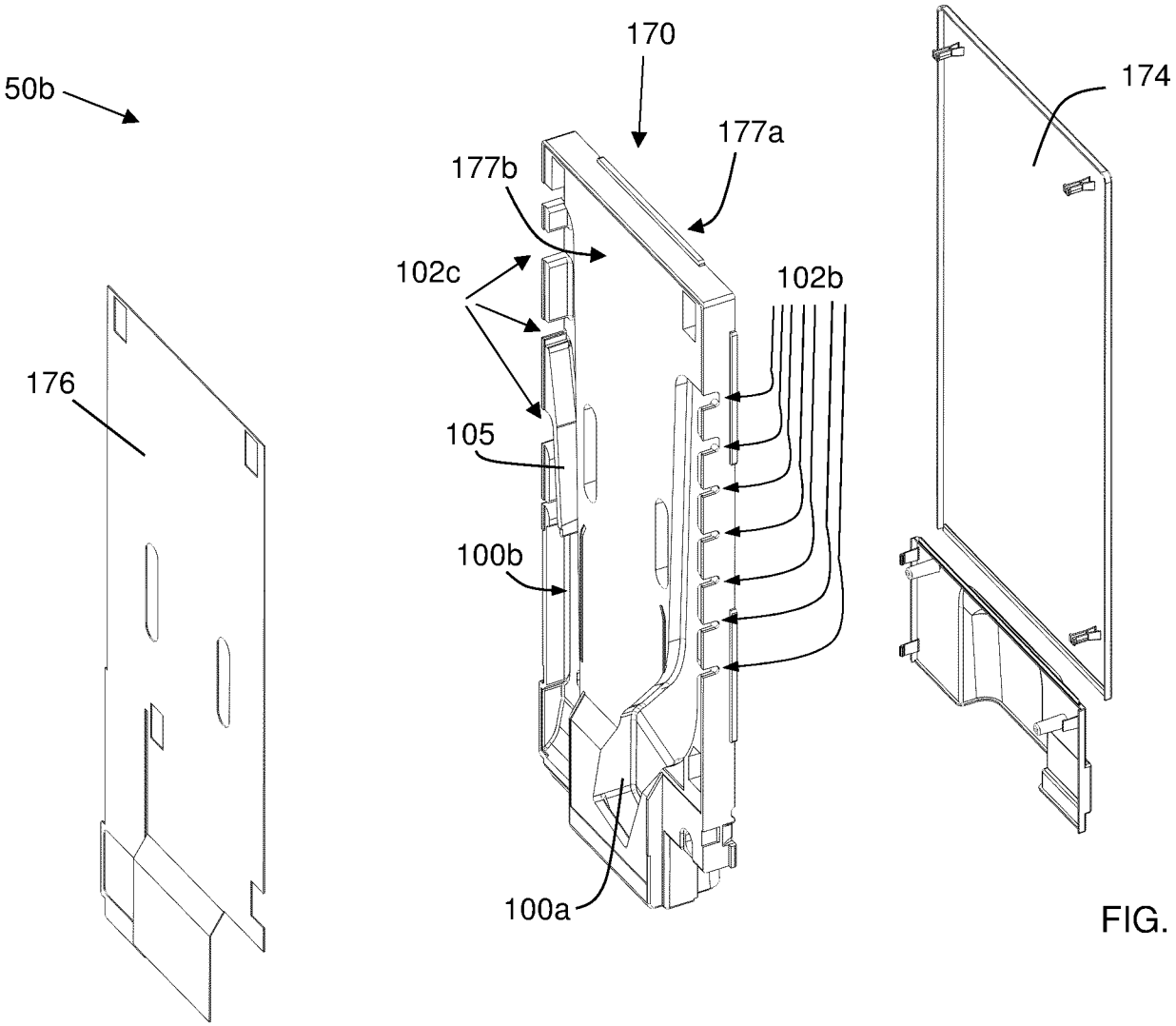
FIG. 8 shows an exploded view of FIG. 6.
Figure 9:
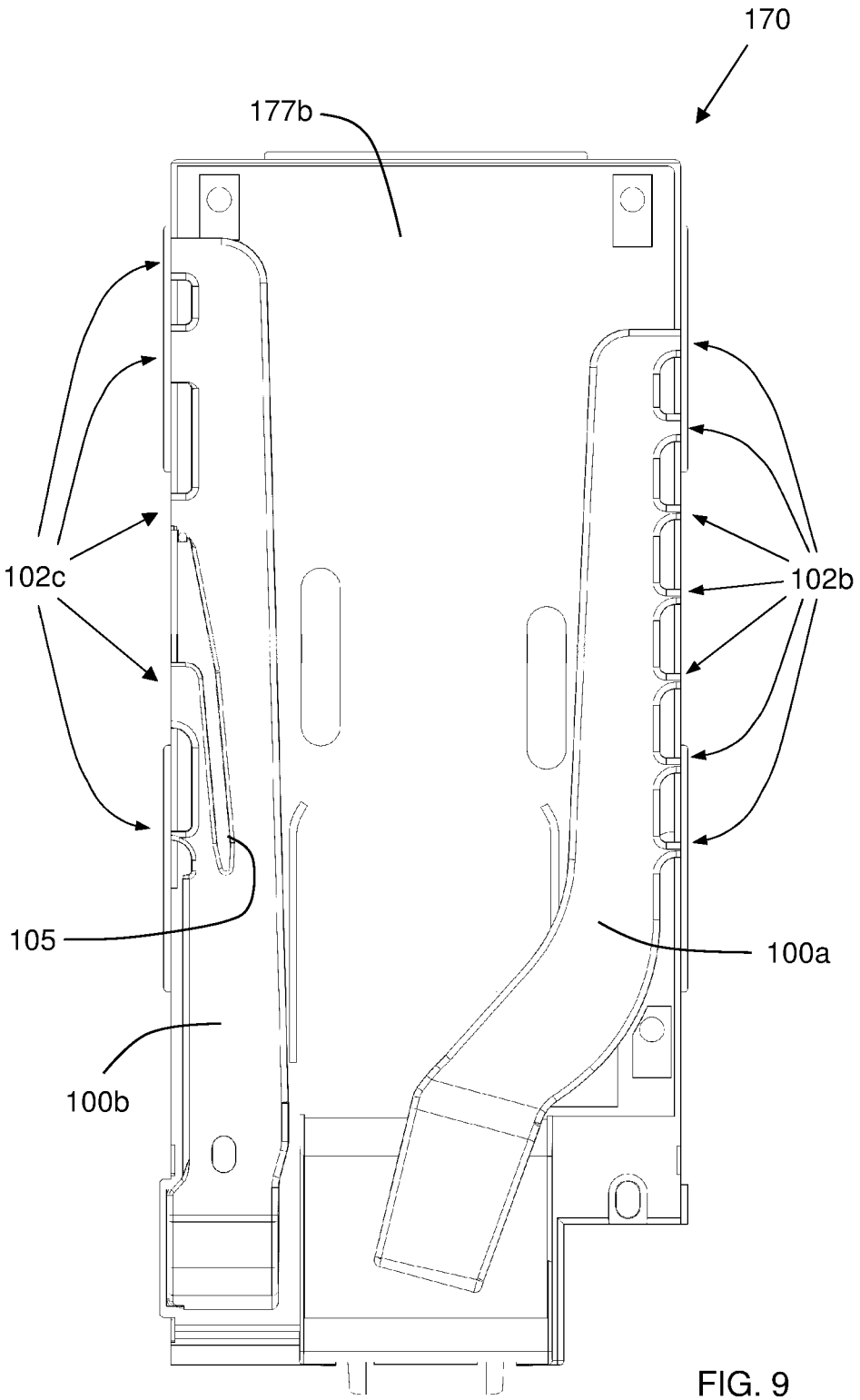
FIG. 9 shows a plan view of an element of FIG. 8 isolated from the rest.

The first air duct 100*a* of the second ventilation assembly 50*b* is preferably realized in a first layer 170 that extends upwardly from the fan 72 up to the upper outlet openings 102*b* (as visible for example in FIGS. 8 and 9).

The first layer 170 is preferably made of expanded polystyrene. The first layer 170 preferably comprises a first lateral side 177*a*, or front side 177*a*, and a second lateral side 177*b*, or rear side 177*b*, opposite to the first lateral side 177*a*.

More preferably, the first air duct 100*a* is realized at the rear side 177*b* of the first layer 170 and communicates with the first row of vertical upper outlet openings 102*b*.

Preferably, a second air duct 100*b* is realized in the first layer 170 and communicates with the second row of vertical upper inlet openings 102*c* (as visible in FIGS. 8 and 9). The second air duct 100*b* is preferably configured to convey/withdraw air from the fresh food compartment 12 towards the freezer compartment 10 and/or to the evaporator 38 (details of the air path from the second air duct 100*b* and the freezer compartment 10 and/or to the evaporator 38 are not shown in the Figures). In a further preferred embodiment of the invention, not illustrated, the second air duct may be preferably configured to withdraw air from the fresh food compartment and then conveys it directly back to the evaporator.

The first layer 170 is preferably sandwiched between a frontal covering plate 174 and a rear covering plate 176.

The frontal covering plate 174 faces the internal volume of the fresh food compartment 12 and it is preferably contemplated that is made from plastic to provide an aesthetically pleasing appearance to a user.

The rear covering plate 176 preferably faces the rear wall 26 of the fresh food compartment 12 and preferably rests on the rear wall 26.

The two air ducts 100*a*, 100*b* of the first layer 170, as illustrated in FIG. 8, are opened in the rear direction, i.e. in the direction of the rear covering plate 176.

Advantageously, the rear covering plate 176 opportunely close the two air ducts 100*a*, 100*b* allowing the air conveyance inside said closed air ducts 100*a*, 100*b*.

Alternatively, the first layer 170 can be sandwiched between the frontal covering plate 174 and the rear wall 26, so that the rear wall 26 closes/delimits the air ducts 100*a*, 100*b*.

In different preferred embodiments, nevertheless, the air ducts may be realized as closed air ducts directly on the first layer. In further different embodiments, then, the air ducts may be realized in any different way. For example, the air ducts may be realized as a box-shaped structure formed of metal sheets joined together.

Furthermore, in preferred embodiments of the invention not illustrated, the refrigerator may be equipped with a regulation system configured to adjust the temperature inside the compartments. The temperature regulation is preferably obtained by adjusting the air volume flowing inside the first air duct. At this purpose, a knob is typically installed inside one of the compartments to be reachable by the user and a movable damper is preferably located inside the first air duct so that the rotation of the knob causes the displacement of the damper in different positions according to the degree of obstructions needed for the variation of temperature required.

Figures 10, 10A:
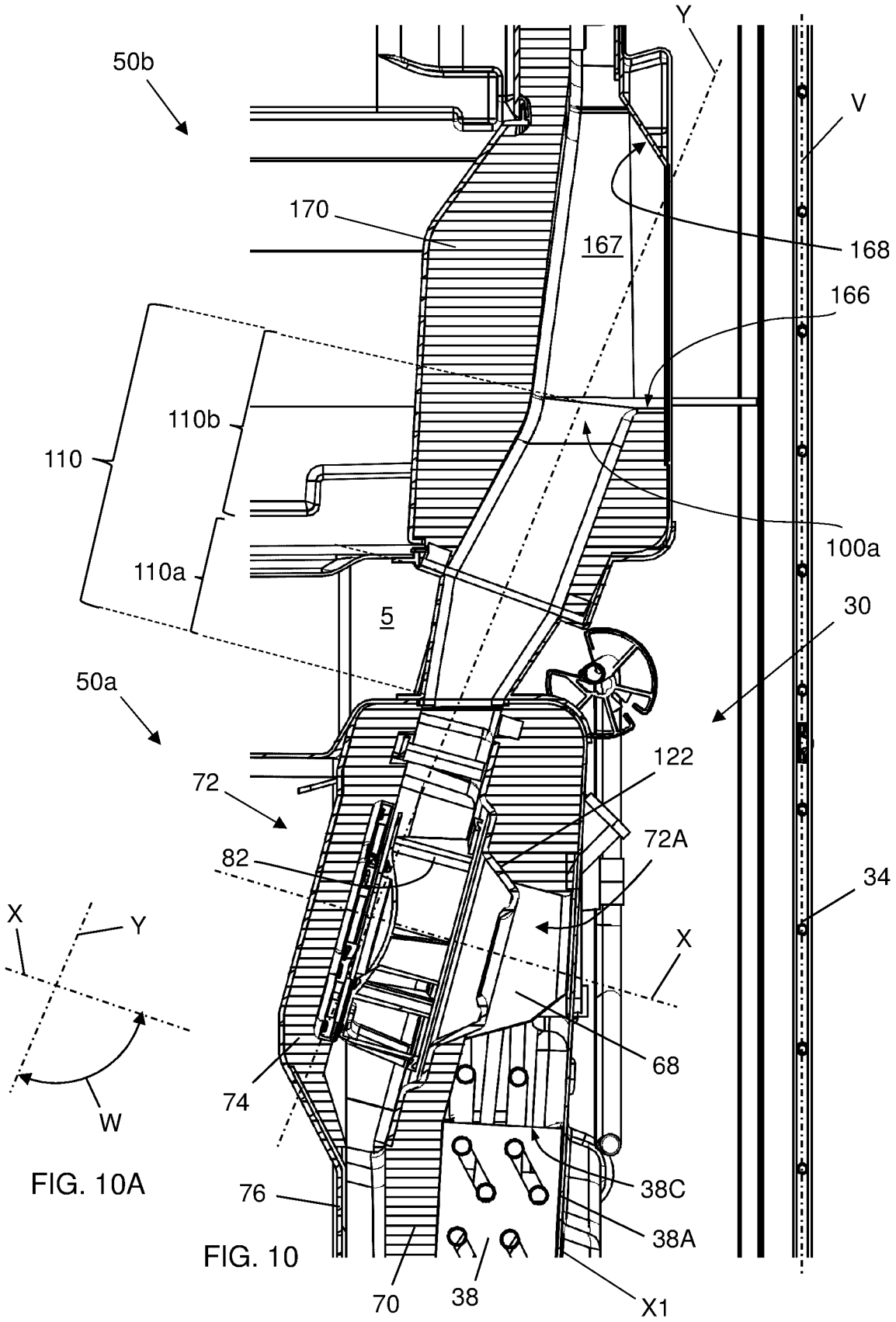
FIG. 10 shows an enlarged view of a particular of FIG. 3.
FIG. 10A shows a detail of axes shown in FIG. 10.
Figure 11:
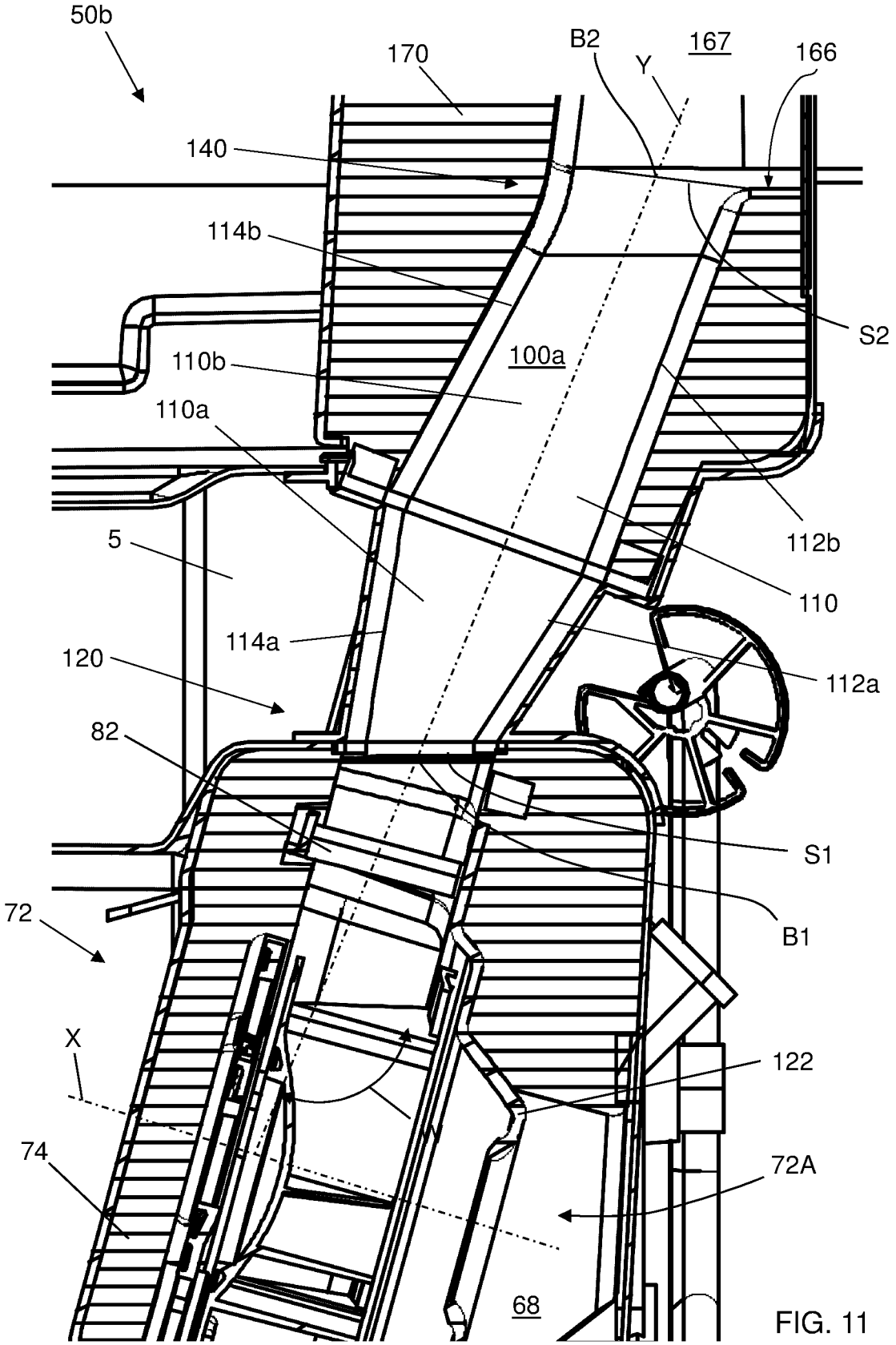
FIG. 11 shows an enlarged view of a particular of FIG. 10.
Figure 12:
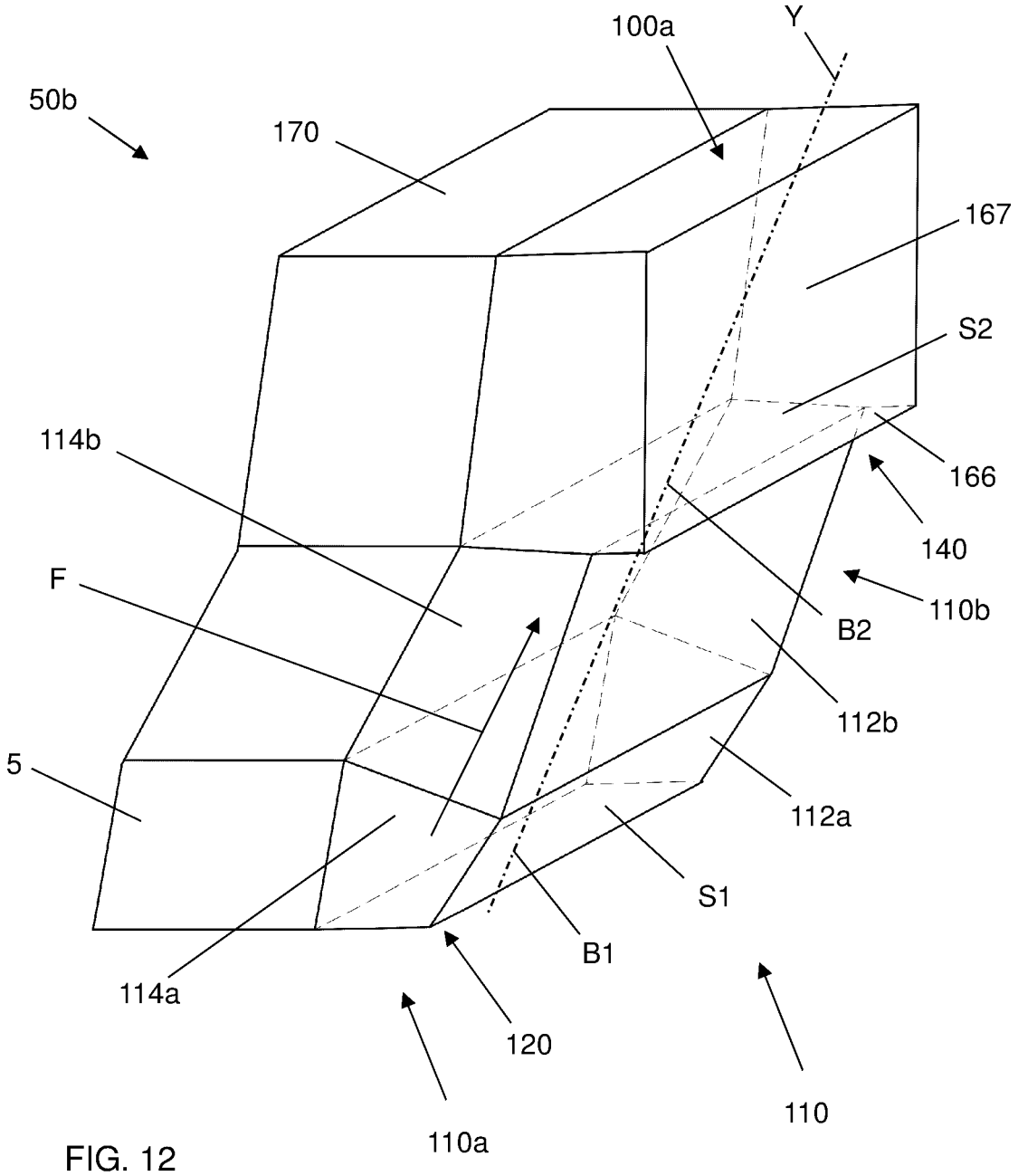
FIG. 12 shows a schematic isometric view in transparency of FIG. 11.
Figure 13:
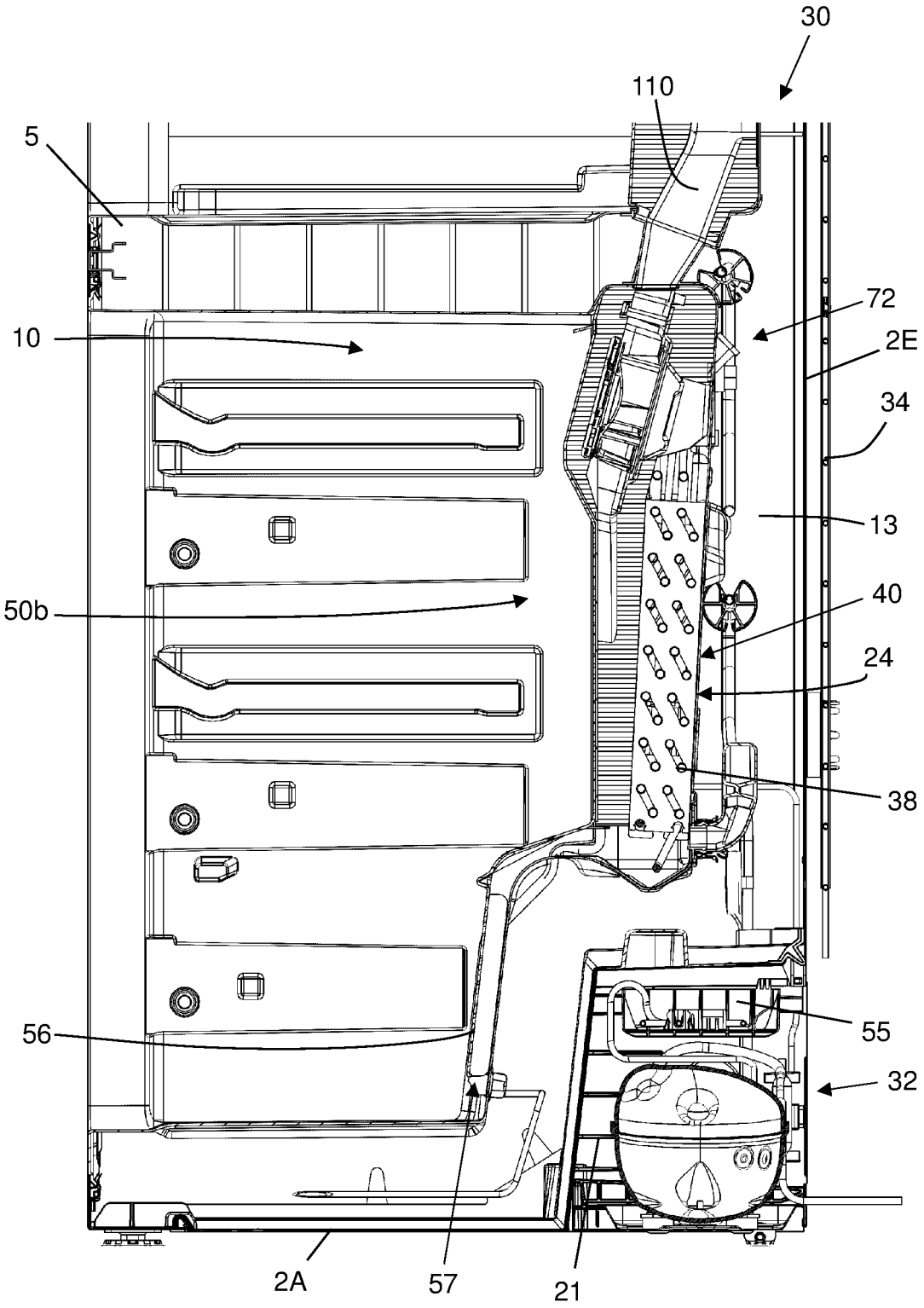
FIG. 13 shows an enlarged view of a particular of FIG. 3.

According to an aspect of the present invention, the refrigerator 1 preferably comprises an interconnection duct 110 configured to connect the first ventilation assembly 50*a* to the second ventilation assembly 50*b*, as better illustrated in FIGS. 10 to 12.

The interconnection duct 110 is preferably arranged downstream of the fan 72 to convey the cooled air forced by the fan 72 towards the second ventilation assembly 50*b*.

According to an aspect of the invention, the interconnection duct 110 extends along a main axis Y which is inclined with respect to the rotation axis X of the rotor 82 of an angle W comprised between 70° and 110°, preferably an angle comprised between 85° and 100°, more preferably an angle equal to 95°.

Preferably, the interconnection duct 110 extends between a first end 120, or proximal end 120, and a second end 140, or distal end 140. The main axis Y is preferably defined as the axis Y passing through the barycentre B1 of a cross sectional area S1 at said proximal 120 and the barycentre B2 of a cross sectional area S2 at said distal end 140.

According to an aspect of the invention, the interconnection duct 110 is an interconnection rectilinear duct 110.

With rectilinear duct it is meant a volume enclosed by at least one side wall allowing an air flow to be channelled along a rectilinear, or substantially rectilinear, flow direction. Preferably said at least one side wall is a rectilinear, or substantially rectilinear, side surface. Preferably said rectilinear, or substantially rectilinear, side surface extends parallelly, or substantially parallelly, to said flow direction.

With reference to FIGS. 11 and 12, it can be appreciated therefore that the interconnection duct 110 is an interconnection rectilinear duct 110 since there are defined side walls 112*a*, 112*b* 114*a*, 114*b* allowing an air flow to be channelled along a rectilinear, or substantially rectilinear, flow direction F. The flow direction F is substantially parallel to the main axis Y of the interconnection duct 110.

Preferably the side walls 112*a*, 112*b* 114*a*, 114*b* are rectilinear, or substantially rectilinear, side surfaces.

More preferably the rectilinear side walls 112*a*, 112*b* 114*a*, 114*b* extends parallelly, or substantially parallelly, to the flow direction F. In the preferred embodiment illustrated in the figures, the rectilinear side walls 112*a*, 112*b* 114*a*, 114*b* are slightly inclined with respect to the flow direction F.

With rectilinear duct it can also be intended that the lateral walls 112*a*, 112*b* 114*a*, 114*b* of the interconnection duct 110 from the cross section S1 provided on the proximal end 120 to the distal end 140 extends along a rectilinear direction.

The interconnection duct 110 is preferably realized as a box-shaped structure.

In different preferred embodiments, nevertheless, the interconnection duct may be differently shaped, for example the interconnection duct may be cylindrically shaped.

According to the preferred embodiment illustrated in the figures, the interconnection duct 110 is substantially preferably defined by two adjacent duct portions 110*a*, 110*b*, preferably a lower duct portion 110*a* and an upper duct portion 110*b*.

Preferably, the lower duct portion 110*a* of the interconnection duct 110 is defined by a duct portion 110*a* defined in the partition element 5 and the upper duct portion 110*b* of the interconnection duct 110 is defined by an inlet duct portion 110*b* of the second ventilation assembly 50*b*.

The inlet duct portion 110*b* of the second ventilation assembly 50*b* is preferably arranged upstream of the upper outlet openings 102*b*. The inlet duct portion 110*b* substantially corresponds to the first part of the first air duct 100*a* of the second ventilation assembly 50*b* and is therefore preferably realized in the first layer 170 of the second ventilation assembly 50*b*.

It is underlined that in the present application the term "upstream" is referred to flowing direction of the air during the standard functioning of the refrigerator 1, i.e. saying that the inlet duct portion is arranged upstream of the upper outlet openings 102*b* means that in the standard functioning of the refrigerator 1 the air firstly passes through the inlet duct portion and then flows through the upper outlet openings 102*b*.

Furthermore, a second portion of the first air duct 100*a* arranged downstream of the inlet duct portion 110*b* of the second ventilation assembly 50*b*, indicated with 167 in FIGS. 10 to 12, preferably widens with respect to inlet duct portion 110*b*. This is obtained through an expansion side wall 167 which preferably extends from the distal end 140 of the first air duct 110*a* perpendicularly to the main axis Y.

The wide second portion 167 of the first air duct 100*a* then preferably comprises an upper inclined side wall 168, as shown in FIG. 10. The inclined side wall 168 advantageously smoothly deflects the air flow from the inside of the second portion 167 to the remaining part of the first air duct 110*a* and then up to the upper outlet openings 102*b*.

According to an advantageous aspect of the invention, by providing such an interconnection duct 110 with said inclination with respect to the rotation axis X of the rotor 82 the air coming from the rotor 82 is smoothly conveyed towards the first air duct 100*a* and, from there, to the upper outlet openings 102*b* and finally inside the fresh food compartment 12. Air flow is therefore advantageously distributed with low turbulence along the interconnection duct 110 and the first air duct 100*a*, thus optimizing the cooling air flowing from the rotor 82 to the fresh food compartment 12. Still advantageously, noise during operation is keep low due to low turbulence of the air flowing into the ducts 110, 100*a*.

According to another advantageous aspect, said arrangement of the interconnection duct 110 and the rotor 82 with said particular inclination allows to optimize the size of ducts 110, 100*a* for the air expelled by the fan 72 towards the compartments 10, 12.

In a preferred embodiment of the invention, the upper outlet openings 102*b* of the second ventilation assembly 50*b* are arranged vertically one above the other, as better visible in FIGS. 8 and 9.

Preferably, the size of an outlet opening 102*b* is higher than the size of an outlet opening 102*b* arranged below. As can be appreciated in the Figures, more preferably, the size of all the outlet openings 102*b* decreases going from the uppermost outlet opening 102*b* to the lowermost outlet opening 102*b*.

Advantageously, the cooled air from the first air duct 100*a* is expelled inside the fresh food compartment 12 through the outlet openings 102*b* at decreasing flow rates going from the upper to the lower part of the fresh food compartment 12. In such a way, being known that the cooled air tends to fall down, it is possible to uniformly distribute the cooling air inside the fresh food compartment 12 since cooled air and warm air mix homogenously.

Therefore, the temperature inside fresh food compartment 12 is more uniformly maintained going from the upper to the lower part of the fresh food compartment 12. In other words, different temperatures, or air stratification, inside the fresh food compartment 12 are prevented/avoided.

In a preferred embodiment of the invention, the upper inlet openings 102*c* of the second ventilation assembly 50*b* are arranged vertically one above the other, as better visible in FIGS. 8 and 9.

Preferably, the size of each inlet opening 102*c* is opportunely dimensioned so that the flow rate of the air leaving the fresh food compartment 12 end entering the second air duct 100*b* through the inlet openings 102*c* is the same, or substantially the same, for each inlet opening 102*c*.

Advantageously, the air leaves the fresh food compartment 12 through the inlet openings 102*c* in an equally distributed manner going from the upper to the lower part of the fresh food compartment 12.

Therefore, again, the temperature inside fresh food compartment 12 is more uniformly maintained going from the upper to the lower part of the fresh food compartment 12. In other words, different temperatures, or air stratification, inside the fresh food compartment 12 are prevented/avoided.

Preferably, inside the second air duct 100*b* and in correspondence of one or more lowermost inlet openings 102*c*, in the preferred embodiment illustrated herein the two lowermost inlet openings 102*c*, a septum element 105 facing the inlet openings 102*c* is arranged. The septum 105 partially obstructs the air passing through the respective inlet openings 102*c*.

Being known that in a configuration with inlet openings arranged vertically the air tends to exit mainly from the lowermost inlet openings, the presence of the septum 105 in correspondence of one or more lowermost inlet openings decreases the effective flow rate of the air passing through the lowermost inlet openings with respect to uppermost inlet openings thus enhancing an equal distribution of air leaving the fresh food compartment 12 going from the upper to the lower part of the same compartment 12.

According to the preferred embodiment illustrated in the Figures and here described, the first ventilation assembly 50*a* and the second ventilation assembly 50*b* are preferably realized as two separated assemblies which are assembled, or pre-assembled, separately and mounted inside the respective compartment 10, 12.

In different embodiments, not illustrated, the first ventilation assembly and the second ventilation assembly may be monolithically realized as an integral body apt to be arranged inside the inner liner, being clear that a partition element is then mounted to the inner liner to divide the inner liner into the freezer compartment and the fresh food compartment.

According to a further aspect of the invention, as better illustrated in FIG. 14, the evaporator 38 shows a first lateral surface 38A extending longitudinally along a first axis X1 and a second lateral surface 38B facing said first lateral surface 38A.

Preferably, the first lateral surface 38A and the second lateral surface 38B are parallel one to the other.

According to the preferred embodiment illustrated in the figures, the evaporator 38 further comprises an upper surface 38C and a lower surface 38D defined between the lateral surfaces 38A, 38B.

Lateral surfaces 38A, 38B with upper and lower surfaces 38C, 38D are preferably arranged to define a parallelepiped.

According to the preferred embodiment illustrated in the figures, the evaporator 38 is a finned tube evaporator comprising a tube 39A having multiple sections one above the other and a plurality of stacked fins 39B (also known as "evaporator battery").

Such evaporator 38 typically comprises a continuous bent tube 39A having straight portions connected by U-bend sections, along which straight portions fins 39B are transversally mounted. The fins 39B are provided with holes, or apertures, having proper shape and size to allow to be assembled transversally along the continuous bent tube 39A. Air advantageously flows through gaps formed between stacked fins 39B and hits the tube 39A.

In different preferred embodiments, the evaporator can be differently shaped, for example flat-shaped evaporators of known type.

In case of a flat type evaporator, the first lateral surface and the second lateral surface are substantially joined at their peripheral edges to define a small border.

According to the present invention, the fan 72 and the air channel 40 are configured so that the air stream vertically flows inside the air channel 40 to affect the evaporator 38.

By saying that the air stream vertically flows inside the air channel 40 it is meant that the air stream flows from the bottom to the upper side of the channel 40, or in a further preferred embodiment the air stream may flow from the upper to the bottom side of the channel.

It is clear that in case of a finned tube evaporator, as shown in the figures, the air stream channelled towards the evaporator 38 passes through the same, particularly through the clearances provided between the stacked fins, preferably the air stream vertically flows vertically inside the evaporator 38 in a direction from the lower surface 38D to the upper surface 38C and is thus subjected to the cooling effect of the evaporator 38.

In case of a flat type evaporator, the air stream channelled towards the evaporator preferably laps the first lateral surface and/or the second lateral surface of the same. It is clear that in this case the air channel is opportunely shaped to define a gap in front of the first lateral surface and/or the second lateral surface where the air stream may flow to be subjected to the cooling effect of the evaporator.

While in the preferred embodiment illustrated and described herein the air stream vertically flows inside the air channel 40 in a direction from the lower surface 38D to the upper surface 38C of the evaporator 38, in different preferred embodiments, not illustrated, the fan and the air channel may be configured so that the air stream vertically flows inside the air channel from the upper surface to the lower surface of the evaporator.

The air channel 40 preferably comprises a first lateral surface 24 and the first lateral surface 38A of the evaporator 38 is preferably supported by the first lateral surface 24 of the air channel 40 and hence rests on it.

In different embodiment, nevertheless, the first lateral surface of the evaporator may be arranged at a predetermined distance from the first lateral surface of the air channel rather than resting on it.

According to an aspect of the present invention, the evaporator 38 is positioned inside the air channel 40 so that said first axis X1 of the first lateral surface 38A is inclined with respect to the vertical direction V.

In other words, the first lateral surface 38A of the evaporator 38 is inclined with respect to the vertical direction V so that the lower part of the first lateral surface 38A is closer to the internal volume of the compartment 10 than the upper part of the first lateral surface 38A.

Figure 14B:
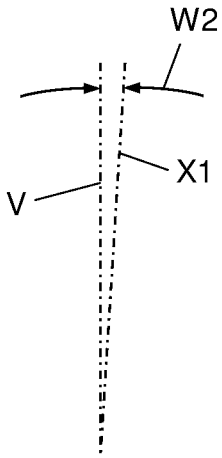
Figure 14C:
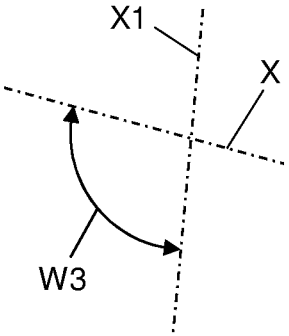
Figure 14:
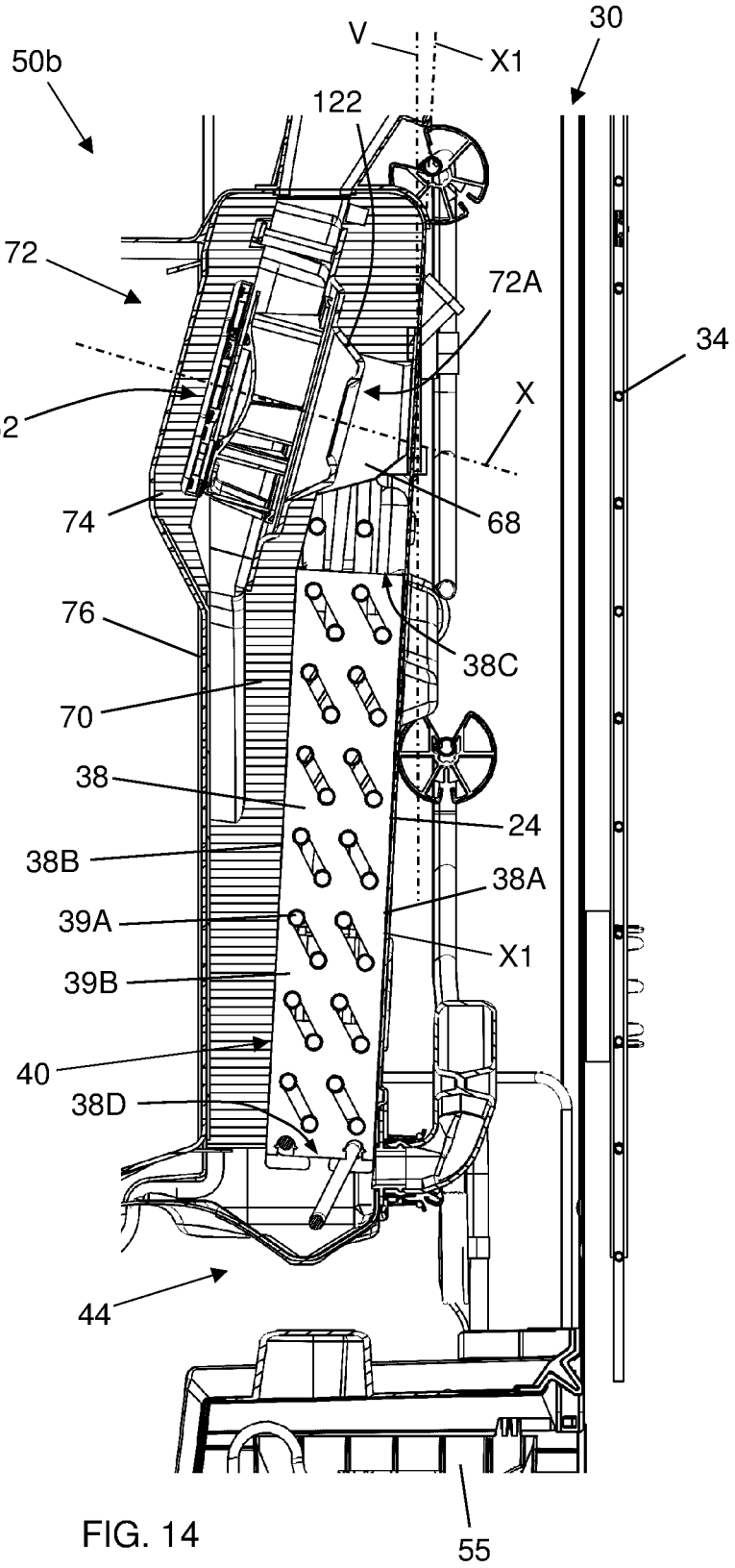
FIG. 14 shows an enlarged view of a particular of FIG. 13.

In the preferred embodiment of the invention illustrated in the figures, the first axis X1 of the first lateral surface 38A of the evaporator 38 is inclined with respect to the vertical direction V of an angle W2 equal to 3°, as shown in FIG. 14B. More generally, the first axis X1 of the first lateral surface 38A of the evaporator 38 is preferably inclined with respect to the vertical direction V of an angle W2 comprised between 1° and 10°, more preferably comprised between 2° and 5°.

Preferably, the first lateral surface 24 is also inclined with respect to the vertical direction V. More preferably, the first lateral surface 24 has the same inclination of the evaporator 38.

According to an advantageous aspect of the invention, by providing such an inclination for said first lateral surface 38A of the evaporator 38, and hence such an inclination for the evaporator 38, an adequate space/room is created at the upper zone of the evaporator 38. Said space is advantageously available and utilized for mounting or arranging one or more operating components, for example the fan 72.

Said space further allows to optimize the air stream from the evaporator 38 to the fan 72, in particular the air stream leaving the upper surface 38C of the evaporator 38 reaching the fan 72, and/or allows to optimize the realization of ducts for the air expelled by the fan 72 towards the compartments 10, 12.

Still advantageously, more space may be created between the evaporator 38 and the fan 72, in particular between the upper surface 38C of the evaporator 38 and the fan 72, so that turbulence and/or noise caused by air flow may be reduced.

According to another advantageous aspect of the invention, by providing such an inclination for said first lateral surface 38A of the evaporator 38, and hence such an inclination for the evaporator 38, the condensed water generated during operation drops to the closed first lateral surface 24.

The condensed water generated inside the evaporator 38 preferably flows throughout its thickness and exits the first lateral surface 38A reaching the first lateral surface 24. The condensed water therefore runs across the evaporator 38 for a short path corresponding at most with its thickness. Advantageously, water does not freeze before reaching the first lateral surface 24 and may reach the water collecting zone 44 and the collecting tray 55 by slipping over the first lateral surface 24. Advantageously, negative frosting effect at the evaporator 38 is reduced and defrosting cycles may also be reduced. The operating efficiency of the refrigerator 1 is therefore increased compared to known system.

Conversely, in vertical evaporator of the known type, the condensed water before reaching the collecting tray runs across the evaporator throughout its height with high probability of frost formation.

It has been surprisingly discovered that by inclining the evaporator 38 with an angle within the ranges above mentioned, i.e. preferably a range of 1°-10° and more preferably a range of 2°-5°, the condensed water generated during operation does not freeze before reaching the first lateral surface 24 and may reach the water collecting zone 44 and the collecting tray 55 but, at the same time, due to its inclination the evaporator 38 does not strongly affect the encumbrance of the refrigeration system 30.

According to a further aspect of the invention, the evaporator 38 and the fan 72 are opportunely arranged so that the first axis X1 of the first lateral surface 38A of the evaporator 38 and the rotation axis X of the rotor 82 form an angle W3 therebetween.

In the preferred embodiment of the invention illustrated in the figures, the first axis X1 and the rotation axis X of the rotor 82 form an angle W3 therebetween equal to 102°. More generally, the first axis X1 of the first lateral surface 38A of the evaporator 38 and the rotation axis X of the rotor 82 form an angle W3 therebetween comprised between 70° and 110°, more preferably comprised between 90° and 105°.

Applicant has recognized that by providing said mutual inclination between the first lateral surface 38A of the evaporator 38 and the rotor 82, it is possible to further optimize the air stream from the evaporator 38 to the fan 72, in particular the air stream leaving the upper surface 38C of the evaporator 38 and reaching the fan 72.

Furthermore, by providing said mutual inclination between the first lateral surface 38A of the evaporator 38 and the rotor 82, applicant has recognized that it is possible to further reduce the noise of the air stream, in particular the noise of the air stream leaving the upper surface 38C of the evaporator 38 and reaching the fan 72.

Still advantageously, by providing said mutual inclination between the first lateral surface 38A of the evaporator 38 and the rotor 82, it is possible to reduce the encumbrance of the system and to optimize the size of the same.

According to the preferred embodiment illustrated and described herein, the evaporator 38 is preferably mounted inside the freezer compartment 10.

More preferably, the evaporator 38 is mounted to the rear wall 24 of the freezer compartment 10 towards the interior volume of the freezer compartment 10.

According to this preferred embodiment, the rear wall 24 of the freezer compartment 10 therefore preferably corresponds to the first lateral surface 24 of the air channel 40. The air channel 40 is eventually defined inside the compartment 10, preferably at said rear wall 24. From the above it follows, therefore, that the condensed water generated during operation advantageously drops to the rear wall 24 and reaches the water collecting zone 44 and the collecting tray 55 by slipping over the rear wall 24.

In different preferred embodiments, nevertheless, the air channel with the evaporator arranged therein may be positioned outside the compartment. In such a case, the air stream from/to the air channel is opportunely exchanged with the internal volume of the compartment through proper communicating apertures defined in one or more side walls of the compartments.

Advantageously, from the above description it has been shown that by providing an interconnection duct downstream the fan it is possible to optimize the air flow from evaporator to the fan and/or to reduce the noise created by the flowing air and/or by the fan rotation and/or to reduce the encumbrance and/or a more efficient moisture collection compared to known system.

Although an illustrative embodiment of the present invention has been described herein with reference to the accompanying drawings, it is to be understood that the present invention is not limited to that precise embodiment, and that various other changes and modifications may be affected therein by one skilled in the art without departing from the scope or spirit of the invention. All such changes and modifications are intended to be included within the scope of the invention as defined by the appended claims.

The invention claimed is:

1. A refrigeration appliance (1) comprising:

an outer cabinet (2) comprising a base (2A) suitable to lay on the ground, a roof (2B) and lateral side walls (2C, 2D, 2E) connecting said base (2A) and said roof (2B) in a vertical direction (V);

a first compartment (10), internal to said outer cabinet (2), with an opening (14) for receiving food items and a second compartment (12), internal to said outer cabinet (2), with an opening (16) for receiving food items, said first compartment (10) and said second compartment (12) being separated one to the other;

a refrigeration system (30) comprising an evaporator (38) for cooling down air and a fan (72) configured to force the cooled air to said compartments (10, 12), said fan (72) comprising a rotor (82) with a rotation axis (X) which is inclined with respect to the vertical direction (V);

a first ventilation assembly (50*a*) apt to channel said cooled air forced by said fan (72) inside said first compartment (10) and a second ventilation assembly (50*b*) apt to channel said cooled air forced by said fan (72) inside said second compartment (12), said first ventilation assembly (50*a*) and said fan (72) being associated to said first compartment (10);

further comprising an interconnection duct (110) configured to connect said first ventilation assembly (50*a*) to said second ventilation assembly (50*b*), said interconnection duct (110) being arranged downstream of said fan (72) to convey the cooled air forced by said fan (72) towards said second ventilation assembly (50*b*), wherein said interconnection duct (110) extends along a main axis (Y) which is inclined with respect to said rotation axis (X) of said rotor (82) of an angle (W) comprised between 70° and 110°, wherein said second ventilation assembly (50*b*) further comprises one or more inlet openings (102*c*) configured to withdraw air from said second compartment (12) towards said first compartment (10) and/or back to said evaporator (38), wherein said second ventilation assembly (50*b*) further comprises a septum element (105) arranged in correspondence with one or more of said inlet openings (102*c*) and is configured to at least partially obstruct the air passing therethrough.

2. The appliance (1) according to claim 1, wherein said main axis (Y) being defined as the axis passing through a barycentre (B1) of a cross sectional area (S1) at said first end (120) and a barycentre (B2) of a cross sectional area (S2) at said second end (140).

3. The appliance (1) according to claim 1, wherein said interconnection duct (110) is an interconnection rectilinear duct.

4. The appliance (1) according to claim 1, wherein said interconnection duct (110) is defined by at least one side wall (112*a*, 112*b* 114*a*, 114*b*).

5. The appliance (1) according to claim 4, wherein said at least one side wall (112*a*, 112*b* 114*a*, 114*b*) is a rectilinear side wall.

6. The appliance (1) according to claim 1, wherein said vertical direction (V) and said rotation axis (X) of said rotor (82) form an angle (W1) therebetween greater than 90° and lower than 180°.

7. The appliance (1) according to claim 1, wherein said first ventilation assembly (50*a*) and said fan (72) are arranged inside said first compartment (10).

8. The appliance (1) according to claim 1, wherein said second ventilation assembly (50*b*) is associated to said second compartment (12).

9. The appliance (1) according to claim 1, wherein said first compartment (10) and said second compartment (12) are separated by the partition element (5) and wherein said interconnection duct (110) is at least in part defined by a duct portion (110*a*) defined in said partition element (5).

10. The appliance (1) according to claim 1, wherein said second ventilation assembly (50*b*) comprises one or more outlet openings (102*b*) apt to channel said cooled air forced by said fan (72) and flowing through said interconnection duct (110) inside said second compartment (12).

11. The appliance (1) according to claim 10, wherein said second ventilation assembly (50*b*) further comprises an inlet duct portion (110*b*) arranged upstream of said one or more outlet openings (102*b*), wherein said interconnection duct (110) is at least in part defined by said inlet duct portion (110*b*) of said second ventilation assembly (50*b*).

12. The appliance (1) according to claim 10, wherein said one or more outlet openings (102*b*) are arranged vertically one above the other.

13. The appliance (1) according to claim 12, wherein a first outlet opening (102*b*) of said one or more outlet openings (102*b*) has a first size, wherein a second outlet opening (102*b*) of said one or more outlet openings (102*b*) has a second size, wherein the first outlet opening (102*b*) is located above the second outlet opening (102*b*), and wherein the first size is larger than the second size.

14. The appliance (1) according to claim 1, wherein said inlet openings (102*c*) are arranged vertically one above the other.

15. The appliance (1) according to claim 1, wherein said septum element (105) is arranged in correspondence of one or more lowermost inlet openings (102*c*) of said inlet openings (102*c*).

16. The appliance (1) according to claim 1, wherein said one or more outlet openings (102*b*) are arranged at one lateral side of said second ventilation assembly (50*b*) and/or said inlet openings (102*c*) are arranged at a second lateral side of said second ventilation assembly (50*b*).

17. The appliance (1) according to claim 16, wherein said one lateral side and said second lateral side are opposite sides of said second ventilation assembly (50*b*).

18. The appliance (1) according to claim 1, wherein said evaporator (38) comprises a first lateral surface (38A) extending longitudinally along a first axis (X1) and a second lateral surface (38B) facing said first lateral surface (38A), said evaporator (38) is positioned so that said first axis (X1) of said first lateral surface (38A) is inclined with respect to the vertical direction (V).

19. The appliance (1) according to claim 1, further comprising an air channel (40) receiving said evaporator (38).

20. The appliance (1) according to claim 19, wherein said fan (72) is associated to said evaporator (38) for creating an air stream which is channeled towards said evaporator (38) inside said air channel (40) and then inside said compartments (10, 12), said fan (72) and said air channel (40) being configured so that said air stream vertically flows inside said air channel (40).

21. The appliance (1) according to claim 18, wherein said first lateral surface (38A) of said evaporator (38) is inclined with respect to the vertical direction (V) so that the lower part of said first lateral surface (38A) is closer to the internal volume of said first compartment (10) or said second compartment (12) than the upper part of said first lateral surface (38A) of said evaporator (38).

22. The appliance (1) according to claim 18, wherein said first axis (X1) of said first lateral surface (38A) of said evaporator (38) is inclined with respect to said vertical direction (V) of an angle (W2) comprised between 1° and 10°.

* * * * *